US005123190A

United States Patent [19]

Erberber

[11] Patent Number: 5,123,190

[45] Date of Patent: Jun. 23, 1992

[54] NOVELTY CUP WITH DISAPPEARING PHOTOGRAPH

[76] Inventor: Ohannes J. Erberber, 212-14 86th Ave., Hollis, N.Y. 11427

[21] Appl. No.: 616,382

[22] Filed: Nov. 21, 1990

[51] Int. Cl.[5] ..... G09F 3/00

[52] U.S. Cl. ..... 40/324

[58] Field of Search ..... 40/324; 272/8 R

[56] References Cited

U.S. PATENT DOCUMENTS

| | | | |
|---|---|---|---|
| 777,305 | 12/1904 | Priestnall | 40/324 |
| 1,561,730 | 11/1925 | Kodama | 272/8 R X |
| 2,217,514 | 10/1940 | Henry | 40/324 X |
| 2,510,237 | 6/1950 | Mahoney | 40/324 |
| 2,577,030 | 12/1951 | Neumann | 40/324 X |
| 2,781,650 | 2/1957 | Lee | 40/324 |
| 2,945,314 | 7/1960 | Baldwin | 40/324 |
| 3,028,085 | 4/1962 | Leong | 40/324 |
| 4,239,223 | 12/1980 | Wilson | 40/324 X |

*Primary Examiner*—Kenneth J. Dorner
*Assistant Examiner*—Milton Nelson, Jr.
*Attorney, Agent, or Firm*—Alfred M. Walker

[57] ABSTRACT

A novelty drinking container device with a disappearing object, such as a photograph such that a drinking cup is separated into top and bottom portions by a convex magnifying lens, with the lens pointed in its apex direction upward toward the mouth of the cup, and the lens is situated above an air space to permit the refraction and distortion of light rays when the cup is empty, and permitting the display of a novelty object, such as a photograph housed in a round-shaped compartment at the base of the bottom section of the cup when clear fluid is introduced into the cup. The clear fluid immerses and submerges the convex magnifying lens, thereby permitting the light rays from the air space to transmit the image of the novelty photograph clearly to the user of the container.

4 Claims, 2 Drawing Sheets

NOVELTY CUP WITH DISAPPEARING PHOTOGRAPH

BACKGROUND OF THE INVENTION

The present invention relates to a novelty drinking container, such as a cup with a disappearing object, such as a photograph.

Devices which relate to the display of photographs, portraits and/or drawings are generally known in the art. However, none of the existing art utilizes the interaction of clear fluids (water, clear soft drinks, white wine, etc.) with a magnifying lens so as to display an object or photograph which can not otherwise be viewed without the introduction of clear fluids.

Existing art, such as Schissel (U.S. Pat. No. 248,219), provides for a container with a lens and a three dimensional picture. But neither Schissel nor Hamilton (U.S. Pat. No. 2,068,950), which concerns a container which discloses a model of the human eye with a lens, are activated by the introduction of water or other clear fluids.

DaCosta and Todokoro (U.S. Pat. Nos. 2,115,886 and 4,778,429 respectively) provide for the viewing of objects through a lens, said objects being suspended in a container of water. But neither inventions are activated by the introduction of water or other clear fluids—or place the objects at the bottom of the container.

The present art, therefore, does not provide a means whereby an object, such as a photograph or a small three dimensional object, such as an engagement ring, can be concealed at the bottom of a drinking container, and displayed only when clear fluids (such as water, clear soft drinks, white wine, etc.) are introduced into the container and rest upon a magnifying lens at the bottom of the container.

SUMMARY OF THE INVENTION

Accordingly, it is an object of the present invention to provide a novelty drinking cup with a disappearing photograph or object which is a departure from existing devices.

More particularly, it is an object of the present invention to provide a novelty drinking cup with a disappearing photograph or object which relies upon the physics of light and displacement of light by water by use of a magnifying lens which distorts the light in the air in the cup so one cannot see the photograph below the lens when the cup is empty.

Another object of the present invention is to provide for the display of the aforesaid photograph or object by the introduction of clear fluids (such as water, clear soft drinks, white wine, etc.) into the novelty cup. When the magnifying lens is completely submerged within the fluid, the fluid neutralizes the light-distorting effects of the lens so that the photograph or object is visible below within the cup.

In keeping with these objects and with others which invention resides, briefly stated, in a novelty drinking container which includes a cylindrically shaped cup, preferably defining two concave curves in sectional profile, beginning at its top and ending at its base. The container may be manufactured out of plastic, glass, porcelain or metal—or other synthetic and nonsynthetic substances. A magnifying lens is placed within the container, preferably at the apex of the concave curves of the container in sectional profile. A photograph or object of interest to the purchaser of the novelty container is placed at the bottom of the cup, below the magnifying lens. An air space exists between the magnifying lens and the photograph or object to be displayed. In the alternative, a cylindrical or other geometric shaped cup with walls being substantially vertical in cross section may be employed. In such a case, the magnifying lens must be placed at a minimum below the top of the cup, since the light-distorting features of the magnifying lens only work if the lens is completely immersed in the clear liquid. Hence, the top apex of the lens must be completely submerged within the clear liquid.

When the cup is empty, light is refracted from the air space through the magnifying lens so that the photograph is not visible. The introduction of a clear fluid (such as water, tea, apple juice, white wine, seltzer, clear soft drinks, etc.) submerges the magnifying lens in the fluid, thereby neutralizing the distortion of light produced by the magnifying lens in an empty cup. The photograph or object becomes visible to the human eye. The image, however, disappears when the fluid is emptied from the cup by the process of drinking—or by the simple emptying of the cup of its fluid contents.

When the novelty drinking cup is designed in accordance with the present invention, it attains the above mentioned objects.

The novel features which are considered as characteristic for the invention are set forth in particular in the appended claims. The invention itself, however, both as to its construction and its method of operation, together with additional objects and advantages thereof, will be best understood from the following description of its specific embodiment when read in connection with the accompanying drawings.

DESCRIPTION OF THE PREFERRED EMBODIMENT

Figure 1:
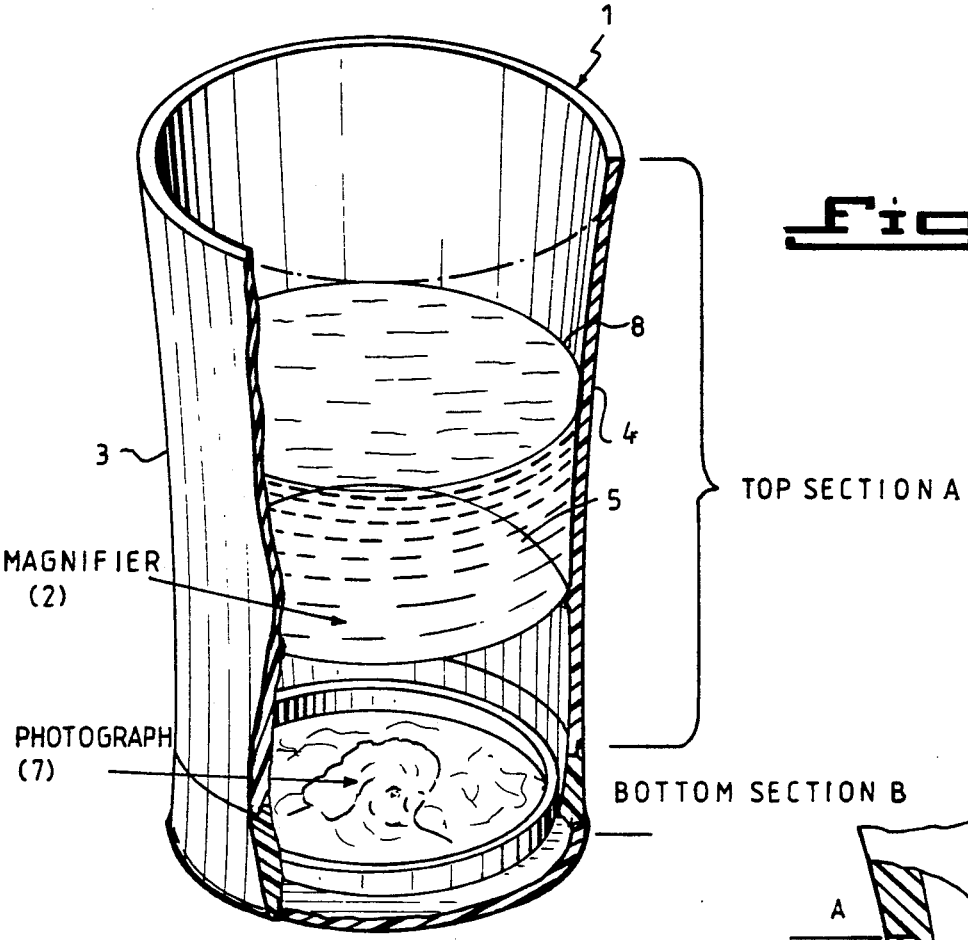
FIG. 1 is a view showing a novelty drinking cup device from a perspective view inside of the cup.

A novelty drinking cup with a disappearing photograph in accordance with the present invention has a drinking cup manufactured out of plastic, metal, glass, porcelain or other synthetic or nonsynthetic substance with reference to numeral 1. The upper container top section A sits over bottom section B. Said novelty drinking cup can be of various sizes, but preferably be shaped cylindrical with opposite concave sidewalls in sectional profile from its base to its top. Within the container, which has left and right sidewalls 3 and 4 when viewed in sectional profile, is fixably placed the convex magnifying lens, denoted by numeral 2. Convex magnifying lens 2 may also be removably fitted within sidewalls 3 and 4 of the novelty drinking cup 1. Convex magnifying lens 2 is situated adjacent to sidewalls 3 and 4 with the apex of the curved portion 5 of magnifying lens 2 pointed toward the mouth of the novelty drinking cup 1. Convex magnifying lens 2 sits above air space 6 which exists to permit the refraction of light through it so as to render novelty photograph 7 or object 7A such as an engagement ring invisible until clear fluid is introduced into novelty drinking cup 1 and reaches clear fluid level 8, thereby eliminating the distortion of light and making said novelty photograph 7 visible.

In the preferred embodiment, the lens 2 is attached to the inside of container 1 at a position equal to the apex of said concave curved walls 3 and 4 in sectional profile. However, in order for the object 7A to be visible, lens 2 must be completely submerged, such that fluid level 8 has a vertical height above the top apex of curved portion 5 of lens 2.

As can be seen in FIG. 1, the novelty drinking cup 1 is manufactured in such a way as to make it a usable means of consuming clear fluids while at the same time permitting the display of the novelty photograph or object 7A when filled to its proper capacity at fluid level 8. Novelty cup 1 may be filled with opaque or dark fluids; but such fluids will not activate the scrambling of the refracted light from air space 6, with the net result being that novelty photograph 7 remains invisible.

Figure 2:
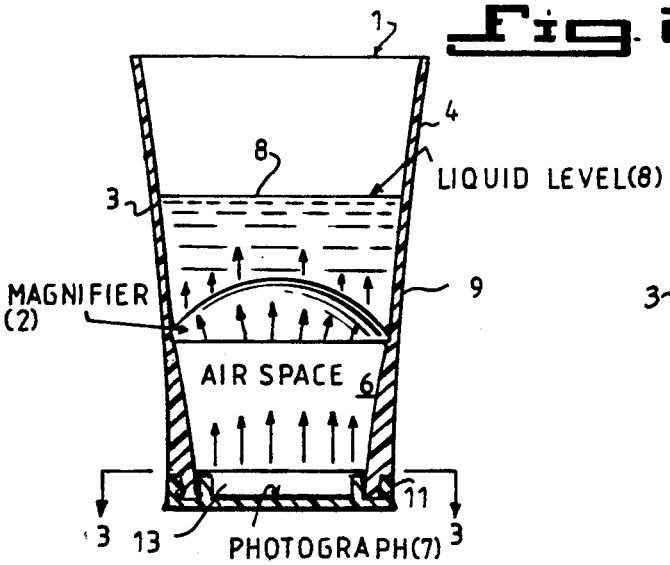
FIG. 2 is a close-up view of the inside of the cup with special emphasis on the magnifying lens.

As seen in FIG. 2, novelty drinking cup 1 consists of a top section 9 which proceeds from the mouth of the cup to the bottom of the convex lens 2. Convex magnifying lens 2 is located within top section 9. Contained below top section 9 below magnifying lens 2 is air space 6. Below air space 6 is situated compartment 13, preferably round, which houses novelty photograph or object 7A.

Figure 3:
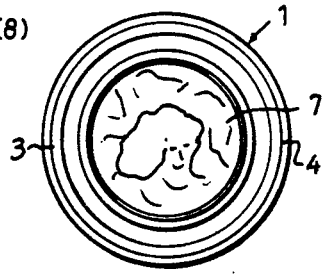
FIG. 3 is a top view of the cup.
Figure 2A:
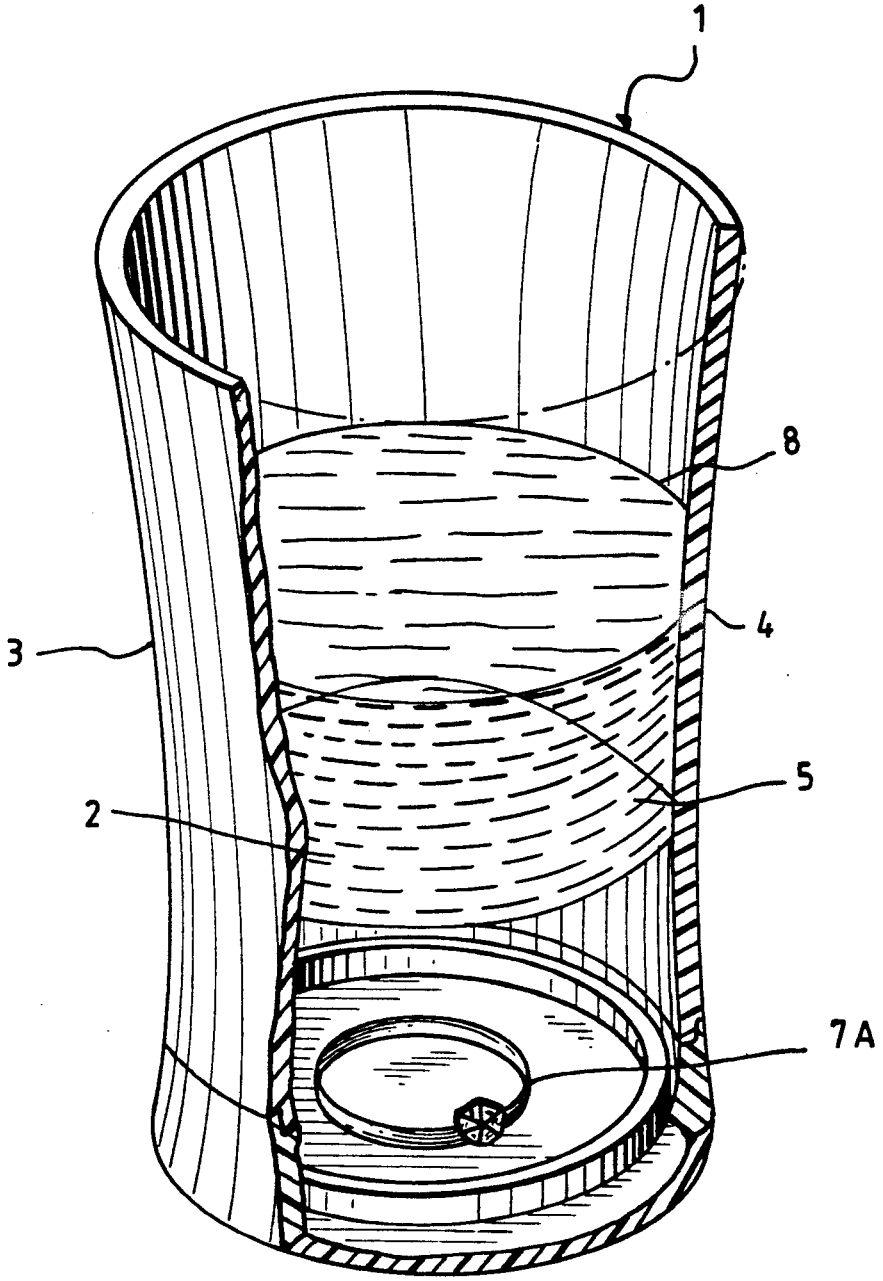
FIG. 2A is perspective view of the cup with a three dimensional ring therein.

As seen in FIG. 3, novelty photograph or object 7A is fastened at the base of bottom section 11 in round compartment 13, between left wall portion 3 and right wall portion 4 of novelty cup 1 in sectional profile.

Figure 4:
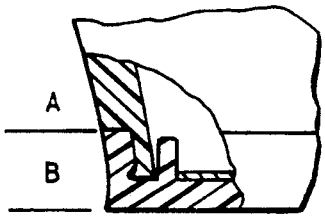
FIG. 4 is a close-up side elevation view of the fastening means of the invention.

As shown in FIG. 4, bottom section B is fastened to top section A by a coupling means.

As can be seen in FIGS. 1, 2, 3 and 4, novelty drinking cup 1 provides a unique means of displaying a novelty photograph by the introduction of clear fluids to a level above a convex magnifying lens, which convex magnifying lens refracts light from an air between itself and a novelty photograph the base of the novelty cup.

The foregoing description is directed towards the construction shown in the specification and drawings herein, but basic modifications may be made without deviating from the scope of the appended claims.

I claim:

1. A novelty container for displaying an object comprising a top upper container section having an upwardly extending wall, a bottom lower base portion forming a recess, said bottom lower base portion having a floor and a wall surrounding said floor and extending upward from said floor, said bottom base portion being removably coupled by a coupling means to said top upper container section, said object housed within said recess, a convex magnifying lens having a curved upper surface and a flat lower surface, said lens being placed within said top upper container section above a first air space said first air space located in spaced relation between said floor of said bottom lower base portion and said flat lower surface of said lens, a second air space located within said top upper container section above said curved upper surface of said lens, the first air space sized to render the object invisible when viewed through said second air space, and to render the object visible when a clear fluid is introduced into said second air space to a height above the top of the convex lens.

2. A novelty container as described in claim 1, wherein the object is a photograph.

3. A novelty container as described in claim 1, wherein the object is a three dimensional object.

4. A novelty container as described in claim 1, wherein the container is a cylindrical drinking cup.

* * * * *